US007669383B2

(12) United States Patent
Darnell

(10) Patent No.: US 7,669,383 B2
(45) Date of Patent: Mar. 2, 2010

(54) FIRE DOOR

(75) Inventor: Duane Darnell, Redmond, OR (US)

(73) Assignee: Warm Springs Composite Products, Warm Springs, OR (US)

( * ) Notice: Subject to any disclaimer, the term of this patent is extended or adjusted under 35 U.S.C. 154(b) by 459 days.

(21) Appl. No.: 11/356,309

(22) Filed: Feb. 15, 2006

(65) Prior Publication Data

US 2006/0207199 A1 Sep. 21, 2006

Related U.S. Application Data

(60) Provisional application No. 60/653,389, filed on Feb. 15, 2005.

(51) Int. Cl.
*E04C 2/00* (2006.01)
*E04C 2/38* (2006.01)
*E04C 2/54* (2006.01)

(52) U.S. Cl. ..... 52/784.11; 52/232; 52/783.11; 52/656.3

(58) Field of Classification Search ..... 52/232, 52/783.13, 784.11
See application file for complete search history.

(56) References Cited

U.S. PATENT DOCUMENTS 1,711,239 A * 4/1929 Mcgranighan ..... 52/801.12
2,003,712 A * 6/1935 Hacker ..... 101/382.1
3,121,262 A * 2/1964 Loncoske ..... 181/290
3,994,110 A * 11/1976 Ropella ..... 428/120
4,132,042 A * 1/1979 Di Maio ..... 52/309.1
4,203,255 A * 5/1980 Naslund et al. ..... 49/399
4,343,127 A 8/1982 Greve et al.
4,367,614 A 1/1983 Warwick
4,716,700 A * 1/1988 Hagemeyer ..... 52/456
4,930,276 A * 6/1990 Bawa et al. ..... 52/211
5,020,292 A * 6/1991 Strom et al. ..... 52/309.9
5,417,024 A * 5/1995 San Paolo ..... 52/456
5,568,713 A * 10/1996 Gagne et al. ..... 52/785.1
5,816,017 A 10/1998 Hunt et al.
6,115,976 A * 9/2000 Gomez ..... 52/232
6,434,899 B1 * 8/2002 Fortin et al. ..... 52/232
6,497,938 B1 * 12/2002 Hill ..... 428/131
6,643,991 B1 * 11/2003 Moyes ..... 52/784.11
6,688,063 B1 * 2/2004 Lee et al. ..... 52/455
6,745,526 B1 * 6/2004 Autovino ..... 52/232
7,007,435 B2 * 3/2006 Ballantyne ..... 52/455
7,210,274 B2 * 5/2007 Ballantyne ..... 52/366
2002/0124497 A1 9/2002 Fortin et al.
2003/0200714 A1 * 10/2003 Minke et al. ..... 52/423
2005/0210797 A1 * 9/2005 Hees ..... 52/455
2005/0284030 A1 * 12/2005 Autovino et al. ..... 52/1
2006/0053744 A1 * 3/2006 Thompson et al. ..... 52/784.1
2007/0193220 A1 * 8/2007 Daniels ..... 52/784.11
2009/0165405 A1 * 7/2009 Fagan et al. ..... 52/204.1

FOREIGN PATENT DOCUMENTS

JP 05149063 A * 6/1993
JP 2004332401 A * 11/2004

* cited by examiner

*Primary Examiner*—Richard E Chilcot, Jr.
*Assistant Examiner*—Ryan D Kwiecinski
(74) *Attorney, Agent, or Firm*—Kolisch Hartwell, P.C.

(57) ABSTRACT

A fire door designed to slow the progress of a fire in a dwelling or commercial building. More particularly, a fire door having one or more vertical stiles that include a layer of intumescent material.

11 Claims, 1 Drawing Sheet

FIRE DOOR

CROSS-REFERENCE TO RELATED APPLICATION

This application claims priority under 35 U.S.C. §119 and applicable foreign and international law and incorporates in their entirety the following U.S. Provisional Patent Application Ser. No. 60/653,389 filed Feb. 15, 2005.

FIELD OF THE INVENTION

The present disclosure relates generally to fire doors designed to slow the progress of a fire in a dwelling or commercial building. More particularly, the disclosure relates to a fire door having one or more vertical stiles that include a layer of intumescent material.

BACKGROUND

The principal means of passive fire protection in structures is by completely enclosing areas with fire barriers. Fire barriers may include fire doors, walls, ceilings, and floors. Fire barriers play an integral role in managing a fire by interrupting the spread of smoke, other toxic gases, and the fire itself from one fire zone into another. Often, the potentially weakest points in a fire barrier are the doors to an area, both because the doors may not be as fire retardant as the walls and ceilings of an enclosure, and also because there generally are cracks under and around the doors through which smoke and toxic gases may pass during a fire.

Fire doors generally are specifically constructed to retard the progress of fires in at least two ways. First, the doors are constructed of fire resistant materials such as steel, fiberglass, certain types of particle board, or diatomaceous earth, among others. Second, fire doors may include one or more regions of intumescent material that expands when heated, minimizing or eliminating cracks in and around the door.

A number of standard tests of fire door effectiveness have been developed for use in the building industry. These are published, for example, in the Uniform Building Code (UBC), the International Building Code (IBC), and by the National Fire Protection Association (NFPA), Underwriter's Laboratories (UL), and the American Society for Testing and Materials (ASTM), among others. Various agencies test fire doors using these standard tests, and assign ratings to fire doors that indicate their effectiveness at slowing the progress of a fire. Door testing agencies include Intertek Testing Services (USA), Underwriter's Laboratories (USA), Omega Point Laboratories (USA), Chiltern International Fire, Ltd. (UK), and Warrington Fire Research (UK), among others. Ratings of fire doors are generally provided in minutes, and typically vary from 45 minutes to 120 minutes.

Disclosures of fire doors are found in U.S. Pat. Nos. 6,115,976 and 6.643,991. The disclosures of each of these documents are incorporated herein by reference. The advantages of the fire door and fire door components provided in this disclosure will be understood more readily after considering the drawings and the detailed description of the preferred examples.

DETAILED DESCRIPTION

Figure 1:
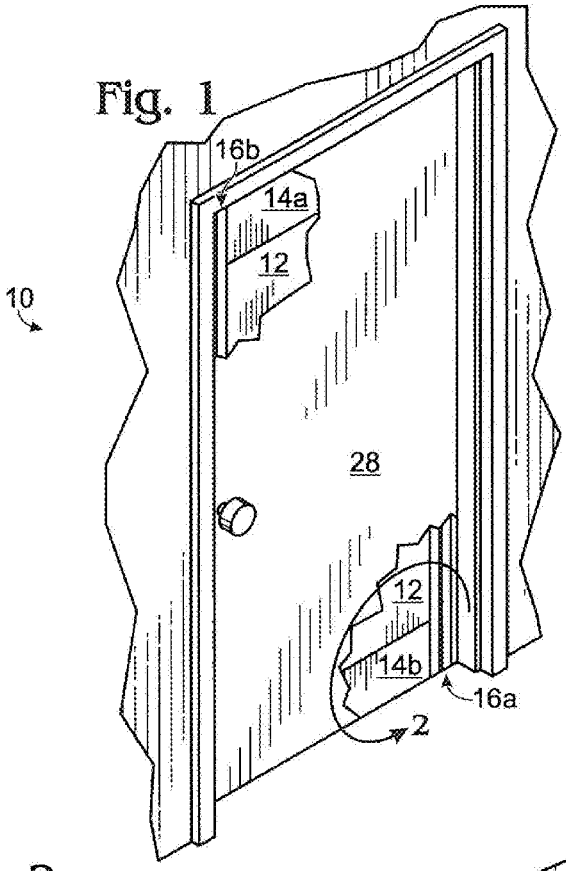
FIG. 1 is a perspective view of a fire door shown mounted in a doorway and with sections of an outer surface cut away to show the internal structure of the door, according to aspects of this disclosure.

Referring to FIG. 1, a fire door is generally indicated at 10. Door 10 may include core 12, top and bottom rails 14*a* and 14*b*, and a pair of stiles 16*a* and 16*b*. The overall dimensions of door 10, including its width (the transverse dimension in FIG. 1), height from top to bottom, and thickness, may be chosen as desired to fit any particular doorway and to achieve a desired fire rating.

Figure 2:
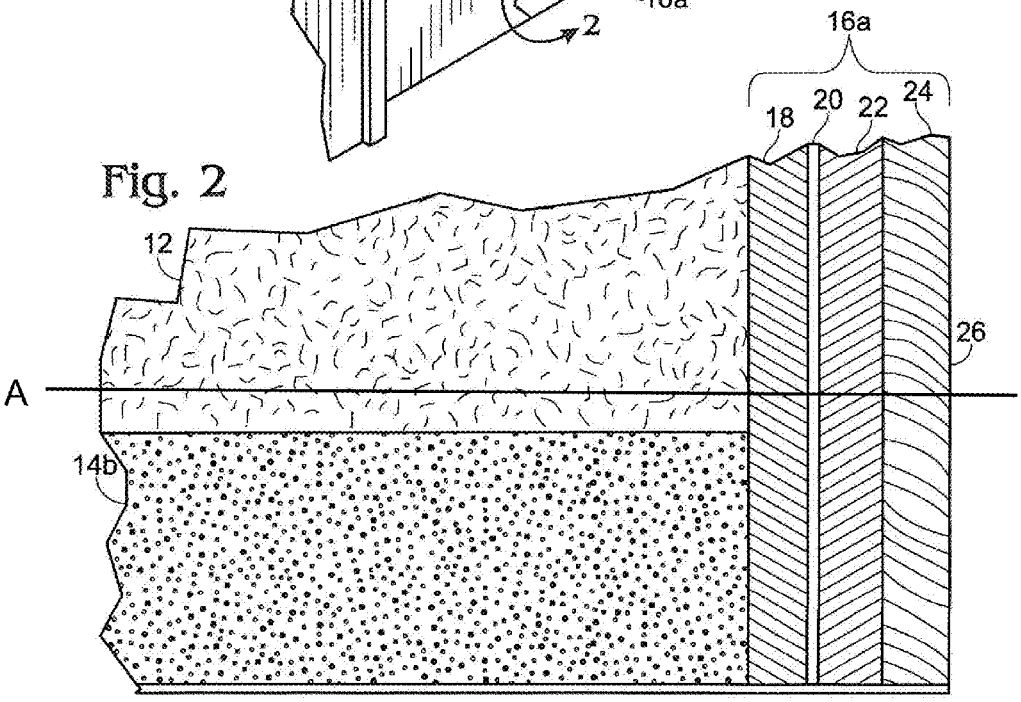
FIG. 2 is a partial sectional view of the lower right corner of the door of FIG. 1, showing details of the construction of the door.

Core 12 is generally substantially rectangular, although other core shapes are within the scope of this disclosure, such as oval, circular, or semicircular cores. As shown in FIGS. 1 and 2, core 12 has front and back planar faces generally parallel to the surrounding wall structure. The core has a known and predetermined density, and a thickness selected, in consideration of the overall weight of the door, to retard the progress of a fire for a desired amount of time corresponding to a particular fire rating. For example, a core with a 60 minute rating may have a density of approximately 18 pounds per cubic foot (pcf), and may have a thickness of approximately 1.675 inches. In general, the core may be formed from any suitable mineral or mineral composite material, with density at least approximately 15 pcf. An example of a suitable core for a door with a 60 minute rating is a Thermal Lite core manufactured by Warm Springs Composite Products of Warm Springs, Oreg.

Rails 14*a* and 14*b* may be constructed from any suitable fire resistant material, for example a mineral or mineral-based material or composite material. The material forming the rails may be chosen to have density and thickness sufficient to achieve any desired fire rating. For example, the rails may have density in the range from 61-72 pcf and thickness of approximately 2.125 inches for a door with a 60 minute rating. Similarly, the rails may be constructed with any desired height to achieve a particular rating. For example, the rails may be at least approximately 2 inches in height for a 60 minute door. The rails may be formed of a proprietary material such as Tectonite, produced by Warm Springs Composite Products of Warm Springs, Oreg., and in general may have thicknesses in the range of 0.5-2.125 inches. The thickness of the rails may be chosen to approximately match the thickness of core 12 and/or other components of the fire door.

Referring now to FIG. 2, stile 16*a* may include two layers 18, 22 of fire resistant particle board, and a layer of intumescent material 20 sandwiched between the two particle board layers. For some applications, it may be possible to achieve desired fire ratings with conventional fiber board such as MDF (medium density fiberboard) in place or instead of fire resistant layers 18 and 22. Stile 16*b* (not shown in FIG. 2) may be similarly constructed. The fire resistant particle board may be constructed from any fire resistant material, such as monoammonium phosphate or monopotassium phosphate, among others. In some embodiments, the particle board layers each may be approximately 10-12 millimeters wide and may have thickness chosen to approximately match the thickness of the core and/or rails of the fire door. An example of suitable particle boards for a door with a 60 minute fire rating are 11 mm wide particle boards manufactured by the Spano Corporation of Oostrozebeke, Belgium. Alternatively, acceptable performance for some applications may be achieved using medium density fiberboard.

As shown in FIG. 2, axis A extends through core 12, perpendicular to edge 26 of door 10, and parallel to rail 14*b* of door 10. Cross-section of stile 16*a* includes a series of layers stacked in the direction of axis A going from core 12 toward edge 26 including (a) fire-resistant particle board 18, (b) intumescent layer 20, (c) fire-resistant particle board 22, and (d) wood layer 24. Wood layer 24 should be selected to have a density and thickness sufficient to achieve a desired fire rating from 45 minutes to 120 minutes.

Intumescent layer 20 is formed of a material such as sodium silicate that expands upon reaching a certain temperature. This causes the fire door to expand and thereby reduces the size of cracks and other gaps around the door through which heat, smoke, and toxic gases may pass during a fire. An example of a suitable intumescent material is Palusol 100, manufactured by the BASF AG Corporation of Ludwigshafen, Germany. Layer 20 may have any suitable width, and in particular it may have width in the range of 1.7-1.9 millimeters, or approximately 0.07 inches, in some embodiments. Layer 20 also may have any suitable thickness, and in particular may have a thickness chosen to approximately match the thickness of surrounding particle board layers 18 and 22. In some embodiments, layer 20 may have a thickness substantially less than the thickness of the surrounding particle board layers, if the thickness of layer 20 is sufficient to cause the desired expansion of the fire door when the door is heated.

One or both of stiles 16*a* and 16*b* further may include a wood layer adjacent to one of the layers of fire resistant particle board. For example, FIG. 2 shows wood layer 24 adjacent to particle board layer 22 of stile 16*a*, such that wood layer 24 forms an external edge 26 of the fire door. Similarly, a wood layer (not shown) may be included in stile 16*b* such that it forms an external edge of the door opposite to edge 26. The wood layers may be formed of any suitable wood, selected to have density and thickness to maintain a certain desired fire rating of door 10. For example, layer 24 may be constructed substantially of hemlock, fir, maple, oak, or a combination of those materials, and may be approximately ½ inch wide. The thickness of the wood layers such as layer 24 may be chosen to approximately match the thickness of the core and/or other portions of the fire door, such as particle board layers 18 and 22 of the stile.

Door 10 may be finished with an outer layer 28 of wood and/or other suitable materials as desired, for decorative purposes or to increase the fire retarding or other properties of the door. For example, wood paneling may be used as an outer layer if the fire door is intended for indoor use in an office setting or in a dwelling, and metal sheeting may be used as an outer layer if the door is intended for outdoor or industrial use.

While the present description has been provided with reference to the foregoing embodiments, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring, nor excluding, two or more such elements.

I claim:

1. A fire door, comprising:

a substantially rectangular core, top and bottom rails each formed substantially of a mineral based, fire resistant material, and a pair of stiles connected to the core along opposing side edges of the door, an axis being defined through the core, perpendicular to the side edges, and parallel to the rails, each including a series of material layers stacked along the axis in a direction from the core toward a respective side edge in the following order:

(a) a first layer of fire resistant particle board;

(b) an intumescent layer adjacent to the first layer of fire resistant particle board;

(c) a second layer of fire resistant particle board adjacent to the layer of intumescent material, and (d) a layer of wood having sufficient thickness and density to achieve a fire door rating of at least 45 minutes.

2. The fire door of claim 1, wherein the core is a mineral core.

3. The fire door of claim 2, wherein the core has density less than 20 pounds per cubic foot.

4. The fire door of claim 1, wherein the rails each have a density in the range from 61 pounds per cubic foot to 72 pounds per cubic foot.

5. The fire door of claim 1, wherein the first and second layers of fire resistant particle board are formed substantially of monoammonium phosphate.

6. The fire door of claim 1, wherein the first and second layers of fire resistant particle board are formed substantially of monopotassium phosphate.

7. The fire door of claim 1, wherein the layer of intumescent material is formed substantially of sodium silicate.

8. The fire door of claim 1, wherein each stile further includes a wood layer adjacent to one of the layers of fire resistant particle board and configured to form an external edge of the fire door.

9. The fire door of claim 1, wherein each layer of particle board has thickness in the range from 10-12 millimeters, and wherein the layer of intumescent material has thickness in the range from 1.7-1.9 millimeters.

10. The fire door of claim 1, wherein the rails each have height of at least 2 inches.

11. The fire door of claim 1, wherein the door has a fire rating of at least 60 minutes.

* * * * *